US005133416A

United States Patent [19]

Dobroselsky et al.

[11] Patent Number: 5,133,416

[45] Date of Patent: Jul. 28, 1992

[54] DEVICE FOR DRILLING HOLES IN THE GROUND

[76] Inventors: Petr V. Dobroselsky, ulitsa Belovezhskaya, 77, kv. 72; Igor V. Nikolaev, ulitsa Musy Dzhalilya, 29, korpus 1, kv. 192, both of Moscow, U.S.S.R.

[21] Appl. No.: 623,714

[22] PCT Filed: Feb. 15, 1990

[86] PCT No.: PCT/SU90/00043

§ 371 Date: Dec. 11, 1990

§ 102(e) Date: Dec. 11, 1990

[87] PCT Pub. No.: WO90/12164

PCT Pub. Date: Oct. 18, 1990

[30] Foreign Application Priority Data

Apr. 11, 1989 [SU] U.S.S.R. ..... 4701291

[51] Int. Cl.[5] ..... E21B 4/00

[52] U.S. Cl. ..... 175/19; 175/323

[58] Field of Search ..... 175/19, 91, 93, 293, 175/315, 320, 323, 325, 377, 394, 398, 399, 408, 414, 416, 424; 173/90, 91, 171

[56] References Cited

U.S. PATENT DOCUMENTS

| | | | |
|---|---|---|---|
| 1,188,982 | 6/1916 | Nebergall | 175/323 |
| 2,579,720 | 12/1951 | Atkinson | 175/414 |
| 3,125,173 | 3/1964 | Fox | 175/323 |
| 3,794,128 | 2/1974 | Gagen et al. | 175/19 |
| 4,100,979 | 7/1978 | Schmidt | 175/19 |
| 4,632,191 | 12/1986 | McDonald et al. | 175/19 |
| 4,785,898 | 11/1988 | Kostylev et al. | 175/19 |

FOREIGN PATENT DOCUMENTS

| | | |
|---|---|---|
| 0273974 | 7/1988 | European Pat. Off. . |
| 2336519 | 7/1977 | France . |
| 0239132 | 8/1969 | U.S.S.R. . |
| 1278410 | 12/1986 | U.S.S.R. . |

OTHER PUBLICATIONS

Kamensky, "Pnevmaticheski mashiny udarnago deistvia dlya prokhodki skvazhin i shpurov", 1986, p. 169.

*Primary Examiner*—Thuy M. Bui

*Attorney, Agent, or Firm*—Burgess, Ryan & Wayne

[57] ABSTRACT

The device for drilling holes in the ground comprises a body (1), a drive and a base member (3), connected with the body by means of a thread (4) and provided a with a lug (7) located on an external side surface (6). The lug (7) is intended for locking the base member (3) relative to the body (1) and is projected beyond the latter. One of the sides (10) is inclined to the generatrix of the side surface (6) of the base member (3) in the direction creating a turning-in moment at the connecting thread. Located on the base member side surface is an additional lug (12) which creates a turning-in moment at the connecting thread in case the device is reversed.

4 Claims, 2 Drawing Sheets

DEVICE FOR DRILLING HOLES IN THE GROUND

FIELD OF THE INVENTION

The present invention relates to the field of construction and in particular to a device for drilling holes in the ground which is widely used in laying of underground service lines under roads and runways of airfields without excavation of trenches, in organization of a closed drainage within the premises of plants, mines, etc., without damaging the pavements, and also in conduct of other similar work in various branches of economy.

BACKGROUND OF THE INVENTION

At present, various devices are used for drilling holes in the ground (cf. SU, A, No. 239, 132), each device comprises a body, a drive for moving the device, a base member screwed to the body. Used as a drive for moving the device are various mechanisms including an impact type pneumatic mechanism whose striker moves in space under pressure of a working agent supplied through a distributing mechanism and a hose held in the body in the preset position with the aid of the base member, a nut, for example.

The main disadvantage of such devices is characterized in that in operation the base member gets self-unscrewed under action of impact and vibration loads from the impact mechanism and due to friction of the base member side surface against the ground. As a result, the base member may be lost or tightness of the impact mechanism may be disturbed.

There are also known similar in design devices for drilling holes in the ground (for example, "Reversible Air Drift NII-4603A", 1986, Kiev, "Reklama", page 6, FIGS. 2, 3 in which a means for locking the base member relative to the body in order to protect the base member from self-unscrewing in the process of operation is made in the form of conical sections located both on the base member and the body. However, such a design of the locking means is not reliable. In the main the explanation consists in that due to the vibration and impact effect of the impact mechanism on the base member and as a result of friction of the base member side surface against the ground, the base member may be either self-unscrewed or screwed into the body. In the latter case the body may be broken in the point of conical joint or the base member may get stuck which will upset the operation of the whole device and hinder its maintenance.

SUMMARY OF THE INVENTION

The present invention aims at providing a device for drilling holes in the ground having a means for locking a base member relative to the body which would prevent inadvertent unscrewing or jamming it in the body making it possible to increase the reliability and extend the service life of the device.

The aim of the invention is accomplished by a device for drilling holes in the ground comprising a body, a drive, a base member screwed to the body, and a means for locking the base member relative to the body, according to the present invention, the means for locking the base member is located on its side surface, projects beyond the body and is made in the form of a lug with one of its sides inclined to the base member side surface generatrix in the direction creating a turning-in moment at the connecting thread.

Due to such a design the projecting part of the locking means cuts into the ground during operation of the device and the resistance reaction of the ground creates a turning-in moment at the connecting thread of the base member thus providing for its constant connection with the body and, consequently, for a troublefree operation of the device. Besides, due to the inclination of the side of the lug to the base member side surface generatrix a directional reaction of the ground is created at the lug. This reaction is necessary for creation of a turning-in moment coincident with the efforts created in mounting the base member in the body which makes the self-unscrewing of the threaded joint impossible.

In accordance with an embodiment of the invention the locking means of the base member is provided with an additional lug located on the base member outer side surface behind the main lug in the direction of the device movement and made similar to the main lug. One of the additional lug sides, the most distant from the main lug, is inclined to the base member side surface generatrix in the direction opposite to the inclination of the main lug side and creating a turning-in moment at the connecting thread in case of the device reversing. Such a relative location and design of the main and additional lugs allow excluding the ingress of dirt onto the non-working side of the main lug in reversing the device and safe-guarding against self-unscrewing of the base member.

The main and additional lugs may be made as one piece, which would allow simplifying the locking means manufacture and avoiding undesirable effect of the forces on the part of the ground on the facing each other non-working sides of the main and additional lugs during direct and reverse movement of the device.

It is expedient to make the base member with a smaller cross-section than that of the body. This would allow decreasing the force of friction of the base member against the ground when the base member is located behind the body in the direction of its motion.

DETAILED DESCRIPTION OF THE INVENTION

The invention will now be described further with reference to specific embodiments thereof, taken in conjunction with the accompanying drawings wherein.

DETAILED DESCRIPTION OF THE INVENTION

Figure 1:
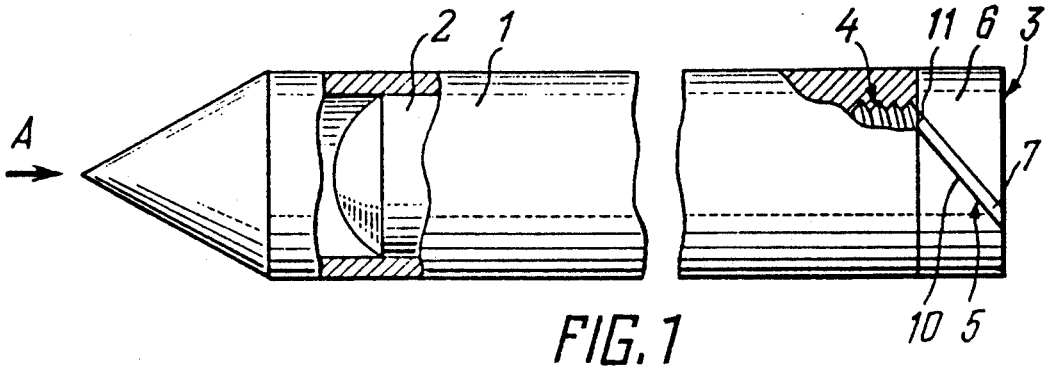
FIG. 1 is schematically represented general view of a device for drilling holes in the ground with three tear sheets, according to the invention.

The device for drilling holes in the ground forming the subject of the present invention comprises a body 1 (FIG. 1), a drive for moving the device in the ground, a base member 3 installed, for example, in the tail portion of the body 1 coaxially with and connected to the latter by means of a connecting thread 4.

Used as a drive 2 in the device are any known drives including a pneumatic drive of impact type whose air distributing mechanism (is not shown) is fixed in the tail portion of the body 1 with the aid of the base member 3.

To exclude the self-unscrewing of the base member 3 provision is made in the device for means 5 intended to lock the base member 3 with respect to the body 1.

Figure 2:
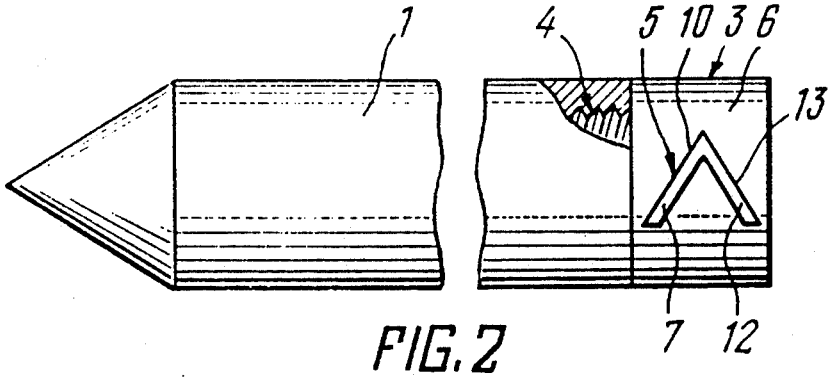
FIG. 2 is an embodiment of the base member locking means, according to the invention.
Figure 3:
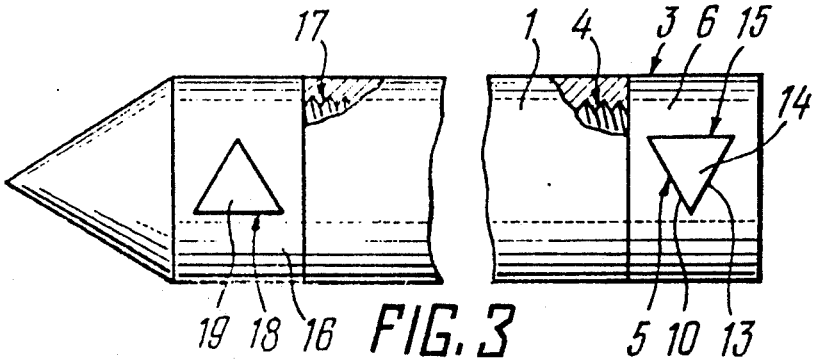
FIG. 3 is a schematically represented embodiment of the device with two locking means according to the invention.
Figure 4:
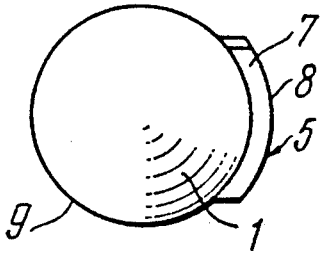
FIG. 4 is a view in the direction of arrow A in FIG. 1, according to the invention.

The means 5 for locking the base member 3 is located on an external side surface 6 of the base member 3 and made in the form of a lug 7 whose structural embodiments are represented in FIGS. 2, 3. In all embodiments the lug 7 is so constructed that its upper edge 8 (FIG. 4) is always located above a side surface 9 of the body 1, that is, it is projected in the radial direction beyond the body 1. In plan the lug 7 (FIG. 1) may have the shape of a parallelogram in which one side 10 is considerably longer than other side 11. As a result, the side 11 produces practically no negative effect on the creation of the turning-in moment. Besides, the side 10 of the lug 7, facing the body 1, is inclined to the generatrix of the side surface 6 of the base member 3 in the direction creating a turning-in moment at the connecting thread 4. In the given example the direction of inclination of the side 10 coincides with the direction of lead of the thread 4 on the base member 3.

In accordance with the embodiment illustrated in FIG. 2, the locking means 5 is provided with an additional lug 12 which is located behind the main lug 7 in the direction of the device motion and is similar in design to the main lug. Besides, a side 13 of the additional lug 12, the most distant from the main lug 7, is inclined to the generatrix of the side surface of the base member 3 and the direction of its inclination is opposite to the inclination of the main lug side 10, that is, it is opposite to the direction of lead of the thread 4 on the base member 3.

As a result, such inclination of the side 13 creates a turning-in moment at the connecting thread 4 in case of reversing the device.

Figure 5:
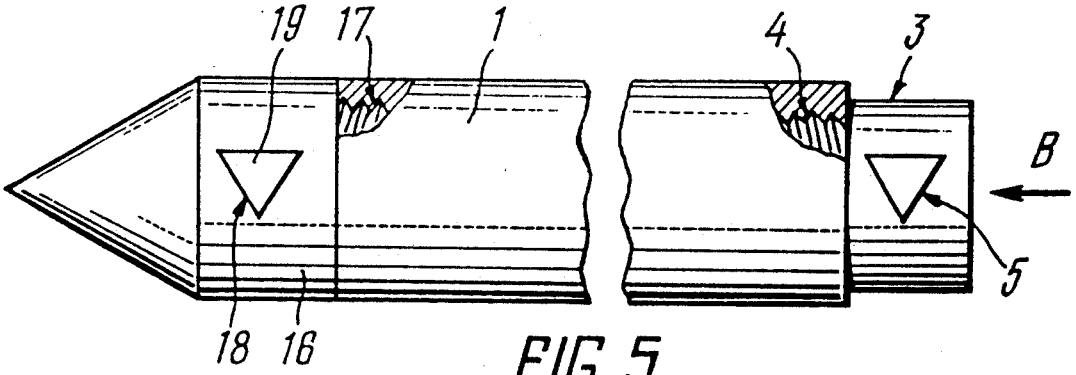
FIG. 5 is similar to FIG. 3 but with the locking means oriented in one direction, according to the invention.

The main lug 7 and additional lug 12 may be manufactured as one piece, that is, as one lug which may be V-shaped as shown in FIG. 2 or have a shape of a trihedral prism 14 as shown in FIGS. 3, 5. Besides, in manufacturing the lugs 7, 12 in the form of the trihedral prism 14 one of its faces 15 is located parallel to the generatrix of the side surface 6 of the base member 3, the second face, directed towards the body 1, is the side 10 of the main lug 7, the third face is the side 13 of the additional lug 12.

Figure 6:
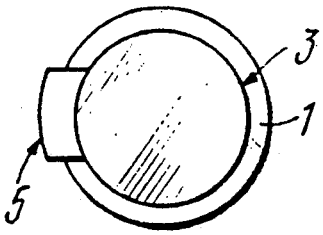
FIG. 6 is a view in the direction of arrow B in FIG. 5, according to the invention.

For decreasing the friction of the side surface 6 against the ground (is not shown in the Figure) the base member 3 is made of a smaller cross-section than that of the body 1, as shown in FIG. 6.

FIGS. 3, 5 show a device whose body 1, in addition to the base member 3 in the tail portion, is provided with a base member 16 in the head portion. The base member 16 is connected with the body 1 by means of a connecting thread 17.

To exclude the self-unscrewing of the base member 16 the device is provided with an additional means 18 for locking this base member 16 relative to the body 1. The locking means 18 is made similar to the means 5 intended for locking the base member 3. Such additional locking means 18 may be manufactured in the form of a lug identical with the lug 7, may be provided with an additional lug identical with the additional lug 12, and also may be made as one part both V-shaped or in the shape of the trihedral prism 19 identical with the trihedral prism 14 of the locking means 5. Besides, the additional means 18 is located relative to the main locking means 5 depending on the direction of the connecting thread 17 of the base member 16 in the head portion. For instance, if the connecting threads 4 and 17 (FIG. 3) on the base members 3 and 10, respectively, are of the same direction (left-hand or right-hand only), the additional locking means 18 is turned relative to the main locking means 5 through 180°, as shown in FIG. 3.

When the threads 4 and 17 (FIG. 5) of the base members 3 and 16, respectively, are of different direction (left-hand and right-hand), the additional locking device 18 is located identically with the main locking means 5, as shown in FIG. 5.

The operation of the device will now be described below.

As the device moves along the preset course under action of impact loads created by the drive 2 (FIG. 1), the reaction of the ground acts upon the lugs 7 of the locking means 5 (is not shown in the Figure). Since the direction of inclination of the side 10 of the lug 7 of the base member 3 is selected in the way described above and illustrated in FIGS. 1, 3, 5, the torque created at this lug as a result of reaction of the ground resistance acts in the direction of turning in the thread 4 of the base member. A similar reaction of the ground takes place at the lug of the additional locking means 18 in the version of the body with the base member 16 located in the tail portion.

In reversing the device, the ground reaction (is not shown in the Figure) acts upon the additional lug 12 (FIG. 2) also facilitating the turning-in of the thread 4 of the base member 3 (or of the thread 17 of the base member 16).

Besides, in the forward and reverse movement of the device, the lugs made in the form of the trihedral prism 14, 19 (FIG. 3) exclude the ingress of the ground between sides 10 and 13 thus making impossible the creation of a turning off moment at the thread.

It may be a stated conclusion that, as a result of a turning-in moment appearing at connecting threads of the base members located in the tail and head portions of the body in the process of the device operation, the possibility of the base members self-unscrewing is excluded and, consequently, the device reliability is increased.

Besides, the locking means forming the subject of the present invention is not subject to failure due to clogging with the ground which also contributes to the increase of the device reliability.

INDUSTRIAL APPLICABILITY

A device for drilling holes in the ground of a proposed design may be widely used in laying the service lines without excavating trenches in construction work of various kinds.

We claim:

1. A device for drilling holes in the ground, comprising:

a body having an outer diameter;

a drive mounted within the body;

a base member connected with said body, said base member having an external side surface;

thread means for connecting said base member with said body; and locking means for locking the base member relative to said body, said locking means being located on the external side surface of the base member and extending radially outward therefrom to an extent greater than the outer diameter of said body, said locking means including a lug with one side thereof inclined to the generatrix of the external side surface of the base member in a direction to create a turning-in moment at said thread means in order to tighten the connection of said base member with said body.

2. A device according to claim 1, wherein said locking means including a second lug located on said external side surface of the base member and offset from the first-mentioned lug in a direction of turning of said device, said second lug being inclined to the generatrix of said external side surface of the base member in a direction opposite to the inclination of said one side of said first-mentioned lug to create a turning-in moment at said thread means in the event that movement of said device is reversed.

3. A device according to claim 2, wherein said first-mentioned and second lugs are each constructed as one-piece lugs.

4. A device according to claim 2, wherein said base member has a smaller cross-sectional dimension than the cross-sectional dimension of said body.

* * * * *